US005111595A

United States Patent [19]

Bessinger et al.

[11] Patent Number: 5,111,595

[45] Date of Patent: May 12, 1992

[54] CHILL ROLL NIP

[75] Inventors: Daniel J. Bessinger, Green Bay; Philip E. Netzer, Appleton, both of Wis.

[73] Assignee: W. R. Grace & Co.-Conn., New York, N.Y.

[21] Appl. No.: 482,465

[22] Filed: Feb. 21, 1990

[51] Int. Cl.[5] ..... F26B 3/00

[52] U.S. Cl. ..... 34/18; 34/62; 34/155

[58] Field of Search ..... 34/62, 60, 113, 114, 34/115, 155, 18

[56] References Cited

U.S. PATENT DOCUMENTS

| | | | |
|---|---|---|---|
| 1,144,896 | 6/1915 | Fosbraey . | |
| 1,890,832 | 12/1930 | von Hoessle . | |
| 1,890,833 | 12/1930 | von Hoessle . | |
| 2,131,257 | 8/1937 | Risley . | |
| 2,526,318 | 10/1950 | Battin | 34/62 X |
| 2,534,973 | 3/1949 | Ipsen et al. | 266/3 |
| 2,855,190 | 3/1956 | Rieger | 263/3 |
| 4,016,030 | 4/1977 | Sobota | 162/199 |
| 4,142,301 | 3/1979 | Goodall | 34/18 |
| 4,154,078 | 5/1979 | Lehmann | 72/201 |
| 4,263,724 | 4/1981 | Vits | 34/62 |
| 4,384,514 | 5/1983 | Larive et al. | 100/38 |
| 4,506,457 | 3/1985 | Lehtinen | 34/41 |
| 4,743,334 | 5/1988 | Singer | 156/499 |
| 4,809,445 | 3/1989 | Meyer et al. | 34/117 |

FOREIGN PATENT DOCUMENTS

| | | |
|---|---|---|
| 8546 | 3/1894 | United Kingdom . |

*Primary Examiner*—Henry A. Bennet

*Attorney, Agent, or Firm*—Kevin S. Lemack; William L. Baker

[57] ABSTRACT

A method and means for forcing a running web into contact with a chill roll is disclosed. The force is created by a second roller positioned with respect to the chill roll so as to create a nip, larger than the web width, through which the web passes. The second roller can be positioned directly above the chill roll, or slightly offset therefrom.

12 Claims, 2 Drawing Sheets

CHILL ROLL NIP

FIELD OF THE INVENTION

This invention relates to a method and means for ensuring substantial contact between a web that moves lengthwise in one direction and a cylindrical surface of a roller around which the web has partial wrapping engagement and which rotates to have the peripheral speed of its said surface match the lengthwise speed of the web.

BACKGROUND OF THE INVENTION

In various processes such as paper making, printing and coating, a lengthwise moving web is, at some point in its Path, brought into partial wrapping engagement around a rotating roller so that the web can have intimate contact with the cylindrical surface of the roller for heat transfer or for some other purpose. A problem that has heretofore persisted in connection with such processes is that there is a tendency for a film of air to intrude between the web and the cylindrical surface of the roller, preventing the desired contact between them.

It is known that a relatively thin "boundry layer" of air is picked up by the moving surfaces of the web and the roller and that some of this air becomes trapped in the wedge-shaped space where the web approaches the roller surface. Unless the web is under a relatively high lengthwise tension, or is moving lengthwise at a relative low speed, the trapped air enters between the roller and the portion of the web that curves around it, forming a film between the roller and all of that portion of the web that is wrapped around it.

If web speed is low enough and the web is under sufficient lengthwise tension, the trapped air in the above-mentioned wedge-shaped space is repelled by the pressure of the web pushing onto the cylindrical surface of the roller. The pressure p exerted by the web in pushing onto the roller surface, in pounds per square inch (psi) and assuming 180° wrap on the chill roll, is given by:

$$p=t/r,$$

where t is web tension in pounds per lineal inch (pli), and r is cylinder radius in inches.

Thus, if a paper or plastic web is under a typical tension of 2 psi and is running around a 12-inch diameter roller, the pressure that pushes the web towards the roller surface is $\frac{1}{3}$ psi. If the speed of the web and cylinder is very low (e.g., less than 100 fpm) a $\frac{1}{3}$ psi web pressure is high enough to almost completely repel the air in the wedge-shaped space from entry between the roller and the portion of the web that curves around it, and the web will make reasonably good contact with the roller surface. Of course, perfect smoothness of the web and roller surfaces is unattainable in practice, and some air will be present between those surfaces in the void spaces defined by surface irregularities, but there will be substantial surface-to-surface contact in contrast to the substantially total separation between the surfaces that exists when a film of air is present.

It will be evident that where a web is to be heated or cooled by a roller around which it is partially wrapped, an insulating film of air between the web and the roller will materially reduce the efficiency of heat transfer. If a freshly imprinted or coated web is passed through an oven and is then brought to a chill roll to be cooled, an air film that intervenes between the web and the chill roll prevents cooling of the web to the temperature it is intended to have upon moving away from the chill roll, and troubles may be encountered in subsequent stages of processing of the web.

Furthermore, the air film may allow solvent to condense on the chill roll surface, forming rather thick layers of ribbons of condensate that the web intermittently reabsorbs in sufficient amounts to resoften the ink. Heatset inks require residual solvent levels of about 10% to 15% in the final product to maintain product quality. Once heated, these solvents continue to evaporate as long as the web temperature is above about 170° F. As web lift off begins, solvent starts to accumulate on the chill roll. Actual accumulation amounts are dependent on coverage, tension, speed and dryer operating parameters.

In web winding and rewinding operations, wherein a substantial length of web is wound onto itself to form a continuous roll, air trapped between the oncoming web and the already-wound part of the roll can form a film between successively wound layers, resulting in a roll that has an excessive diameter, is too loosely wound, and may create problems during subsequent handling or use, as by telescoping when tilted.

Again, where an idler roll is to be driven by means of a moving web, a thin film of air between the web and the roll reduces the friction force needed for driving the roll, and serious slippage between them may result.

The development of an air film between a web and a roller around which it has partial wrapping engagement can sometimes be avoided by mounting a pressure roller in juxtaposition to the roller to be contacted by the web, whereby the web is literally squeezed into contact with that roller. However, there are many situations in which this expedient cannot be used because the web surface that faces away from the roller to be contacted cannot tolerate engagement by a solid object.

U.S. Pat. No. 3,452,447, issued to T. A. Gardner in 1969, points out that holding a web tightly to a drum such as the steam cylinder of a dryer "has long presented problems" due to entrained air trapped between the web and the drum, "thereby greatly reducing the transfer of heat". The patent proposes to mount an air bar to blow air against the web from the side of it that is opposite the drum, the air bar being positioned along the line at which the web is tangent to the drum. The patent recognizes that blowing air directly towards the web in an effort to force it into contact with the drum would normally be ineffectual because the air jet or jets, after impacting the web, would be deflected or redirected by it into flow along its surface that would produce a lift effect; and "the lift effect of the redirected jets is sufficiently great so that it tends to nullify the pressure exerted by the jets". Instead, Gardner's air bar has a pair of outlets which are spaced apart by a small distance in the direction of movement of the web and from which air jets issue towards the web at opposite substantially oblique angles to its surface such that they converge towards one another. The convergent air jets are said to produce a pressure zone between the air bar and the web, in the region between the outlets from which they are emitted, and the patent states that "the pressure exerted over the relatively large area of the pressure zone [is] so much greater than the lift effect of the redirected jets that the latter ceases to be of any consequence".

The expedient disclosed by Gardner may be of value where web tension is rather high—as expressly contemplated by the patent—and with moderate web speeds, but it is doubtful that it would be effective with relatively high web speeds and small or moderate tensions. In all cases it would require a substantially high rate of air flow to be effective and would therefore consume a substantial amount of energy in its normal operation.

U.S. Pat. No. 4,369,584, assigned to the assignee of the instant invention, discloses the use of a high velocity air jet to force a moving web into contact with a rotating roller, such as a chill roll. Although such an approach has been successful, the jet demands a substantial energy requirement to generate the high pressure air.

U.S. Pat. No. 4,462,169 also assigned to the assignee of the instant invention, discloses a chill nip which depends upon the use of an interference fit. Thus two cooperating rolls form an adjustable nip clearance maintained at about 0.001 inches less than the thickness of the web. However, the resulting physical compression of the web can damage not only the printed surface, but the web itself.

SUMMARY OF THE INVENTION

The problems of the prior art have been overcome by the instant invention, which provides a method and means for applying sufficient downward force onto a moving web to hold it substantially in contact with a rotating roller, such as a chill roll. Specifically, an additional roller such as a chill roll is stacked over or is slightly offset from an existing roller with which the moving web is desired to be in partial wrapping engagement. The two rollers create a nip through which the web passes. The additional roller is aligned to close clearances with the existing roller such that any air gaps are forcibly removed.

Accordingly, it is an object of the present invention to provide energy efficient means for forcing a moving web into contact with a rotating roller.

It is a further object of the present invention to provide means for mitigating the film of air that tends to intrude between a moving web and the cylindrical surface of a roller.

It is a still further object to mitigate solvent condensation on the surface of a roller.

These and other objects of the invention will become more apparent from the following detailed description and accompanying drawings.

DETAILED DESCRIPTION OF THE INVENTION

Figure 1:
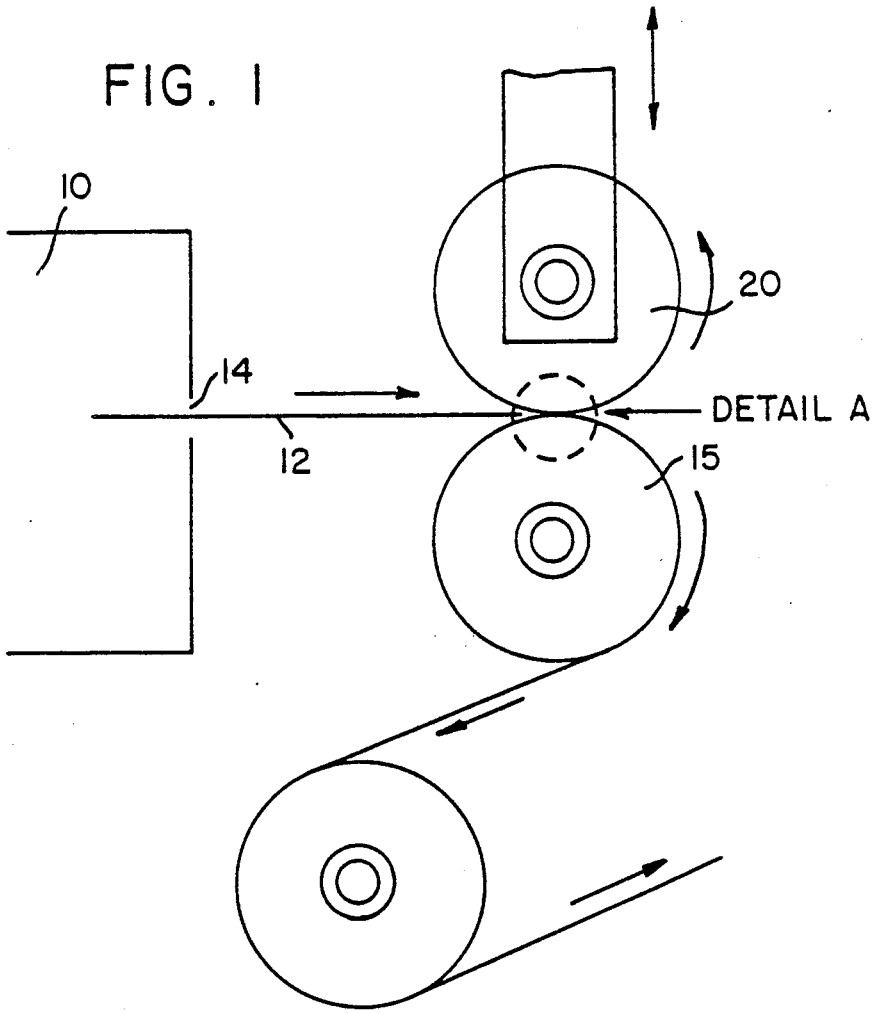
FIG. 1 is a diagrammatic side view of the apparatus of the present invention.
Figure 2:
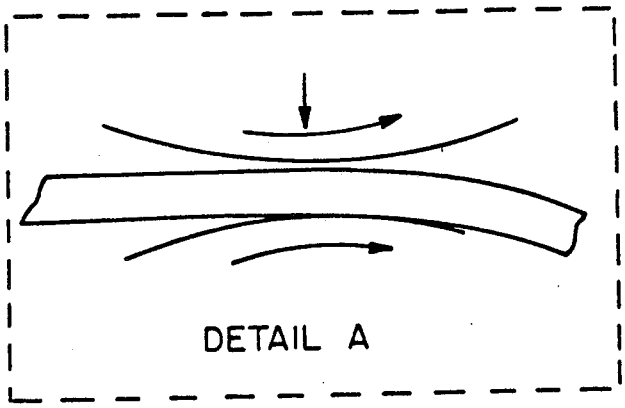
FIG. 2 is an enlarged view of Detail "A" in FIG. 1 showing the nip formed in accordance with the present invention.

Turning now to FIG. 1, a portion of a dryer assembly 10 is shown, out of which web 12 is driven through web slot 14. In conventional apparatus, the freshly coated or imprinted web 12 emerges from the dryer 10 in a heated state. Cooling of the web 12 is accomplished by passing it over the surface of a cooling cylinder 15, known in the art as a chill roll. The chill roll 15 functions to transfer heat from the hot web 12 emerging from the dryer 10 to the medium cooling the chill roll, such as water, to thereby cool the web 12 and solidify the ink or coating applied to the web 12. The web moves lengthwise from dryer 10 to chill roll 15 at speeds in the order of 1000–3000 fpm. Chill roll 15 rotates at an appropriate speed such that the peripheral speed of its surface is substantially matched to the web speed.

As intimated earlier, the intersection of the boundry layers of air on the web and chill roll tends to form an air wedge between the web and the chill roll surface, and can force the web away from that surface causing "web lift-off". Problems associated with web lift-off include inefficient heat transfer, loss of drive friction, and difficulty in winding up rolls of film or paper which are not too hard or too soft. In addition, solvent condensation starts to accumulate on the chill roll. Accumulation amounts are dependent upon ink coverage, tension, speed and dryer operating parameters. If the accumulation is substantial enough, the moving web absorbs a large enough portion of the accumulated condensate per unit area to resoften the ink the cause smearing and blocking of the web.

In accordance with the present invention, means is provided to create an opposed force that would force web 12 in close enough proximity to chill roll 15 so as to avoid the formation of condensate.

The opposed force is preferably created by a chill nip roll 20 positioned so as to create a nip with chill roll 15. The nip is large than the thickness of web 12 so as to avoid a calendaring effect. The web 12 and nip roll 20 create an opposed air wedging force bringing the web clearance from the roll 20 and the web clearance from the roll 15 into equilibrium. The additional force associated with weight and position of roll 20, web tension and web weight allows the clearance from the chill roll 15 to the web to be less than that necessary to achieve deleterious solvent condensate formation. The diameter of the roll 20 is not critical so long as the roll can be adequately cooled to keep the roll surface temperature below the ink pick-off point, and its weight in addition to the weight of the supporting mechanism supplied enough downward force to overcome the lift-off force. However, the advantages of a larger roll 20 diameter creating a greater downward air wedge force will be apparent to those skilled in the art.

The chill nip roll 20 is a cooled, rotating chill roll supported vertically and positioned by stops. The device should have a design operating clearance about equal to the sum of the chill roll and nip roll radial run-outs above the normal thickness of web 12. Ideally, the rolls should be designed for zero radial run-out. Radial run-out is defined as the total variation in a direction perpendicular to the axis of rotation of a reference surface from a surface of revolution. Radial run-out includes eccentricity and out of roundness, and is usually about twice the eccentricity. The roll 20 is rotated at speeds substantially equal to o greater than the speed of the web, and to match web direction. The clearance between chill nip roll 20 and chill roll 15 is controlled by limiting stops to insure adequate downward repositioning of the web 12 and allowing for a slight amount of web compression as a result of chill roll radial run-out and variations in web thickness. Solvent condensate is not problematic with chill nip roll 20, as it is not exposed to the amount of contact area that takes place with chill roll 15.

In one embodiment of the instant invention, the center of chill nip roll 20 is positioned directly over the center of chill roll 15 as is shown in FIG. 1. However, it will be appreciated by those skilled in the art that the center of chill nip roll 20 need not be positioned directly over the center of chill roll 15. The operative factor is to create the sufficient opposed force to mitigate web lift-off and the resultant solvent condensate accumulation. Chill nip roll 20 can be positioned at a point other than tangency and thus offset from chill roll 15 to create a slight "S" wrap in one direction. Thus, the chill nip roll 20 can be positioned at a point upstream of the chill roll 15 along a path of web travel around chill roll 15, and lowered to create the additional bend the web 12 has to travel through. This orientation utilizes web momentum and apparent centrifugal force to drive the web into roll 15 to help eliminate the air gap.

In the preferred embodiment, the nip is formed with the first chill roll that the web encounters as it exits the dryer. Typically the web temperature after the first chill roll is low enough so that the solvent evaporation rate is sufficiently small from the standpoint of deleterious solvent condensation on subsequent chill rolls. However, should deleterious solvent condensation occur on subsequent chill rolls, the nip could be formed there as well.

Figure 3:
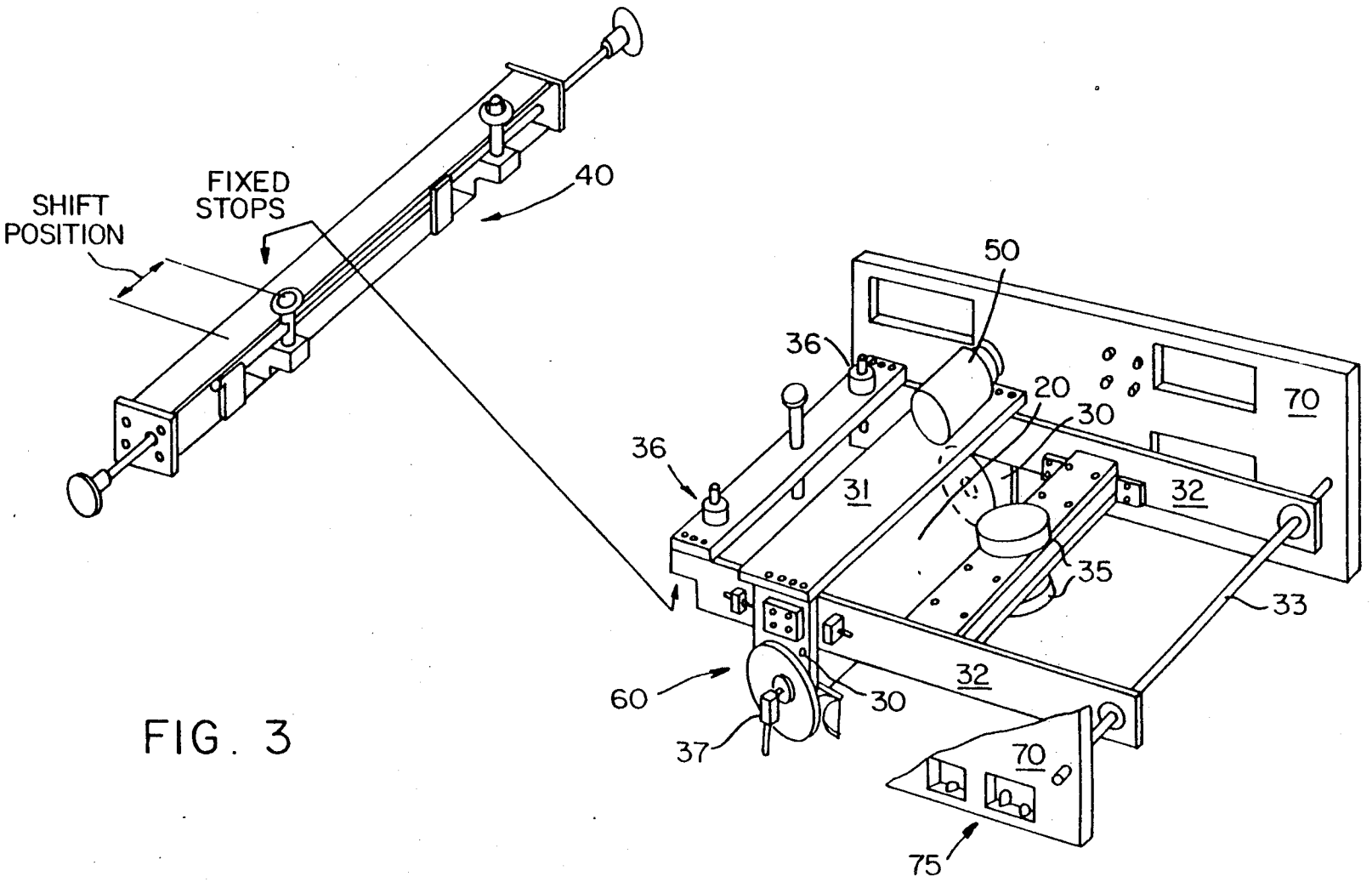
FIG. 3 is a diagrammatic view of the chill nip roll mechanism of the present invention.

FIG. 3 shows an example of a supporting apparatus for chill nip roll 20. The chill nip roll 20 is mounted on each end by self aligning ball bearings which are themselves mounted to vertical plates 30 supported at the top to one flat Plate 31. The flat plate 31 rests across two horizontal members 32 which pivot about a single shaft 33 at the other end of the mechanism. The horizontal movement is controlled by four adjustment dowels. The chill nip mechanism is raised and lowered using pressurized air bags 35. Other suitable means for raising and lowering the mechanism include pneumatic cylinders. There are two adjustable stops 36 which consist of commercially available shaft phase coupling harmonic drives with a 100 to 1 turning ratio. This allows very fine adjustment capabilities, on the order of thousandths of an inch. The chill nip roll is cooled by water which enters one end 37 and leaves the other through hydraulic unions. There is a safety mechanism shown generally at 40 included which automatically slides into place disallowing any lowering of the nip roll 20 after it has been raised for whatever reason. The mechanism 40 comprises a spring loaded bar that slides under the horizontal plates 32 to physically prevent downward movement of the mechanism in the case of an emergency stop, shutdown (less than 10% speed) or normal stop. At one end of the mechanism 40 is a limit switch that detects that the operator has pushed in the safety bar allowing the nip roll to be lowered into position, so as to provide added safety. The chill nip 20 automatically lifts up when there is an emergency stop, press is less than 10% speed or the operator pushes the manual stop button. Also, the controls can be made to raise the nip roll when a web splice is coming through the system. The chill nip roll 20 is motor/belt driven by drive 50. The drive package can be made to match the first chill roll speed or it can bring the nip roll 20 up to some higher speed if deemed necessary. The whole mechanism moves up and down inside two side plates 70 which are mounted on an existing chill stand at 75. A brake 60 should also be incorporated into the device for safety reasons.

Of course, those skilled in the art will appreciate that other approaches to engaging the chill roll nip can be used, such as driving the chill roll nip directly off the chill stand or press through pulleys and belts or gears.

To best utilize the invention, assuming the chill nip roll is in the top-dead-center position relative to the first chill roll, the press operator first makes preliminary adjustments to the mechanical stops in order to set the roll-to-roll gap. These adjustments are based on web weight. While in the raised position, the operator then brings the chill nip roll up to matching speed with the press, through the engagement of direct driven clutching or the starting of a motor (whichever applies). Following the release of any safety devices, the nip roll is then lowered into position where final adjustments to the mechanical stops is made to enhance operating results.

What is claimed is:

1. Apparatus for cooling a web having an upper and lower surface, said apparatus comprising a first chill roll having a rotating cylindrical surface onto which the lower surface of the web travels in partial wrapping engagement, said lower surface of said traveling web and first chill roll surface each carrying a thin boundary layer of air which together form a first air wedge where said web approaches said cylindrical surface; and means to create a second air wedge opposing said first air wedge, said means comprising a second chill roll having a second rotating cylindrical surface, said second chill roll forming with said first chill roll a nip through which said traveling web passes, said nip being larger than the thickness of the web, said upper surface of said web and second chill roll surface each carrying a thin boundary layer of air which together form said second air wedge where said web approaches said second rotating cylindrical surface.

2. The apparatus of claim 1 wherein said first and second chill rolls rotate to have a peripheral speed substantially matching the speed of the web.

3. The apparatus of claim 1 wherein said first chill roll rotates to have a peripheral speed matching the speed of the web and said second chill roll rotates at a peripheral speed greater than the speed of the web.

4. The apparatus of claim 1 wherein said second chill roll is stacked substantially directly over said first chill roll.

5. The apparatus of claim 1 wherein said second chill roll is offset from said first chill roll.

6. In apparatus wherein a web coated with a solvent is confined to lengthwise motion in one direction along a defined path and wherein said path has one portion in which the web extends substantially straight and has another portion which begins at the termination of said one portion and in which the web is curved in partial wrapping engagement with a cylindrical surface of a first roller that rotates to have the peripheral speed of its said surface match the speed of lengthwise motion of the web, means for substantially preventing the intrusion of an air film between the first roller and the web, said means comprising:

a second roller positioned to cooperate with said first roller so as to form a nip therebetween through which said web moves, said nip being dimensioned larger than the thickness of the web; said second roller creating in association with the web weight and the tension of said web, a force sufficient to prevent the accumulation of solvent condensate on said cylindrical surface of said first roller.

7. The apparatus of claim 6 wherein said second roller is stacked substantially directly over said first roller.

8. The apparatus of claim 6 wherein said second roller is offset from said first roller.

9. A method of substantially eliminating web coating solvent condensate from accumulating on a surface of a chill roll onto which said web is directed to travel in partial wrapping engagement, said method comprising creating, in association with the weight and tension of said web, a force opposing that formed as said web approaches said chill roll, to cause said web to move towards said chill roll surface, said force being created by positioning a second roll in relation to said chill roll so as to form a nip through which said web travels, said nip being larger than the thickness of said web.

10. A method according to claim 9, wherein said second roll is stacked substantially directly over said chill roll.

11. A method according to claim 9 wherein said second roll is offset from said chill roll.

12. A method according to claim 9 wherein said force is created by said second roll in association with its position with respect to said chill roll, its weight, and the weight and tension of said web.

* * * * *